US006415623B1

(12) United States Patent
Jennings et al.

(10) Patent No.: US 6,415,623 B1
(45) Date of Patent: Jul. 9, 2002

(54) POINT OF SALE PRODUCT CHILLER

(75) Inventors: Thomas A. Jennings, Winston-Salem; Theodore A. Pierce, Pfafftown; Eugene C. Pierce, III, Greensboro; Stephen E. Bertrand, Winston-Salem, all of NC (US)

(73) Assignee: Cold Sell Systems, LLC, Winston-Salem, NC (US)

( * ) Notice: Subject to any disclaimer, the term of this patent is extended or adjusted under 35 U.S.C. 154(b) by 0 days.

(21) Appl. No.: 09/755,938

(22) Filed: Jan. 5, 2001

(51) Int. Cl.[7] ..... F25D 3/08

(52) U.S. Cl. ..... 62/457.2; 62/371; 62/530; 62/125; 62/246

(58) Field of Search ..... 62/371, 457.2, 62/530, 125, 246

(56) References Cited

U.S. PATENT DOCUMENTS

| | | | | |
|---|---|---|---|---|
| 309,233 | A | 12/1884 | Luhmann | |
| 608,701 | A | 8/1898 | Morse | |
| 2,271,802 | A | 2/1942 | Nordskog | 62/89.5 |
| 2,317,005 | A | 4/1943 | Wasserman | 62/91.5 |
| 2,393,245 | A | 1/1946 | Hadsell | 62/1 |
| 2,427,230 | A | 9/1947 | Salzmann | 62/31 |
| 2,453,017 | A | 11/1948 | Kaufman | 62/133 |
| 2,612,761 | A | 10/1952 | Hilker | 62/116 |
| 3,130,163 | A | 4/1964 | Avera | 252/67 |
| 3,254,502 | A | 6/1966 | Ellis | 62/257 |
| 3,399,546 | A | 9/1968 | Kuns et al. | 62/371 |
| 3,491,548 | A | 1/1970 | Christiansen | 62/255 |
| 3,807,194 | A | 4/1974 | Bond | 62/457 |
| 3,974,658 | A | 8/1976 | Starrett | 62/60 |

(List continued on next page.)

FOREIGN PATENT DOCUMENTS

| | | |
|---|---|---|
| CA | 622107 | 6/1961 |
| GB | 511685 | 8/1939 |
| GB | 808690 | 2/1959 |

OTHER PUBLICATIONS

Photocopy of a brochure entitled New Cambro Food Bars; Cambro Manufacturing Co. 1994.
Photocopy of a brochure entitled CamKiosk System With the CamKisok, Just Add the Food . . . and You're in Business! Cambro Manufacturing Company 1998.
Photocopy of a brochure entitled Camkiosk Features from Cambro Manufacturing Co. 1998.
Photocopy of a brochure entitled Serving milk is way cool from Cambro Manufacturing Co. 2000.
Photocopy of a brochure entitled Build Your Yogurt Business The Yoplait Way 1987.
Cambro Unit as Displayed at CSFSA Apr. 18, 2000.
"Cold Bag" Versa–Flex Single and Double Crates.

*Primary Examiner*—William C. Doerrler
*Assistant Examiner*—Mark S. Shulman
(74) *Attorney, Agent, or Firm*—MacCord Mason PLLC

(57) ABSTRACT

An improved point-of-sale product chiller that is modular in design and construction whereby the server may be readily produced in various sizes and capacities for point-of-sale display and sale of chilled products. An insulated enclosure includes a base panel, a pair of sidewall panels, and a plurality of modular end wall panels that form a chilled product cavity. The panels are formed of hollow, blow-molded thermoplastic with foam insulation panels inserted therein. A chiller of a desired size is produced by selecting a base panel of the desired size and assembling to it modular end wall panels and sidewall panels of the desired size. One or more insulated central divider panels may be assembled within the enclosure to form multiple chilled product cavities within the enclosure. Removable, flat cold cell panels having cooperating edges are inserted about the inner periphery of the enclosure to maintain product temperatures inside the cavities.

31 Claims, 9 Drawing Sheets

U.S. PATENT DOCUMENTS

| | | | | | |
|---|---|---|---|---|---|
| 4,176,747 | A | | 12/1979 | Aho | 206/509 |
| 4,220,048 | A | | 9/1980 | Grepiotis et al. | 73/323 |
| 4,292,817 | A | | 10/1981 | Loucks | 62/457 |
| 4,319,629 | A | | 3/1982 | Hotta | 165/47 |
| 4,324,111 | A | | 4/1982 | Edwards | 62/457 |
| 4,344,301 | A | | 8/1982 | Taylor | 62/457 |
| 4,348,827 | A | | 9/1982 | Brinker | 40/607 |
| 4,399,668 | A | | 8/1983 | Williamson | 62/457 |
| 4,441,336 | A | | 4/1984 | Cannon | 62/457 |
| 4,498,312 | A | | 2/1985 | Schlosser | 62/457 |
| 4,505,132 | A | | 3/1985 | Howes et al. | 52/457 |
| 4,722,199 | A | | 2/1988 | Hibino | 62/344 |
| 4,724,682 | A | | 2/1988 | Flum et al. | 62/462 |
| 4,775,002 | A | | 10/1988 | Iwamoto | 165/47 |
| 4,910,975 | A | | 3/1990 | Derby | 62/372 |
| 4,923,077 | A | | 5/1990 | Van Iperen et al. | 220/3.1 |
| 4,941,327 | A | | 7/1990 | Miles | 62/246 |
| 4,946,032 | A | | 8/1990 | Stoddard et al. | 206/44 R |
| 4,982,840 | A | | 1/1991 | Bidwell et al. | 206/223 |
| 4,995,238 | A | | 2/1991 | King | 62/125 |
| 5,048,171 | A | | 9/1991 | Bidwell et al. | 29/401.1 |
| 5,048,305 | A | | 9/1991 | Taub | 62/372 |
| 5,101,642 | A | | 4/1992 | Alexandrov | 62/371 |
| 5,159,973 | A | | 11/1992 | Pennington et al. | 165/48.1 |
| 5,169,020 | A | | 12/1992 | Spamer | 220/444 |
| 5,240,125 | A | | 8/1993 | Kunz | 211/59.3 |
| 5,261,253 | A | | 11/1993 | Spenard | 52/250 |
| 5,351,839 | A | | 10/1994 | Beeler et al. | 211/59.3 |
| 5,433,085 | A | | 7/1995 | Rogers | 62/372 |
| 5,493,874 | A | * | 2/1996 | Landgrebe | 62/457.2 |
| 5,596,880 | A | | 1/1997 | Welker et al. | 62/372 |
| 5,598,943 | A | | 2/1997 | Markus | 220/410 |
| 5,669,233 | A | | 9/1997 | Cook et al. | 62/371 |
| 5,704,485 | A | | 1/1998 | Cautereels et al. | 206/546 |
| 5,924,302 | A | * | 7/1999 | Derifield | 62/457.2 |
| 5,927,092 | A | | 7/1999 | Kushen et al. | 62/258 |
| 6,067,810 | A | | 5/2000 | Jennings et al. | 62/246 |
| 6,116,029 | A | * | 9/2000 | Krawec | 62/3.3 |
| 6,151,910 | A | * | 11/2000 | Hazen | 62/457.2 |
| 6,209,343 | B1 | * | 4/2001 | Owen | 62/457.2 |
| 6,237,765 | B1 | * | 5/2001 | Hagen et al. | 206/315.11 |
| 6,244,458 | B1 | * | 6/2001 | Frysinger et al. | 220/592.09 |

* cited by examiner

POINT OF SALE PRODUCT CHILLER

BACKGROUND OF THE INVENTION

This invention relates generally to insulated containers for the protection of temperature sensitive goods and more particularly to an insulated container for the display and sale of chilled products at point-of-sale locations in stores, convenience stores, cafeterias, eateries, lunchrooms, hotels, outdoor pavilions, theme parks, county fairs, catered events, sports arenas, stadiums, convention centers, and the like.

Generally, for keeping temperature-sensitive foodstuffs, especially beverages, chilled, either an electrically refrigerated cabinet or an insulated container filled with ice has been used. For example, as a student passes through the lunch line he/she usually passes a large electrically refrigerated cabinet filled with cartons of milk. Also, convenience stores generally have point-of-sale insulated containers filled with iced-down beverages. There are numerous problems associated with either method of cooling individually packaged beverages as discussed in the specification of U.S. Pat. No. 6,067,810 assigned to the assignee of the present applicant.

For example, traditional electrically refrigerated cabinets are large and cumbersome, and are difficult to access by small persons or children. The units are not easily movable and this prevents convenient rearrangement of the store, eatery or lunch line as needed. These cabinets generally require a substantial capital investment. Additionally, as with other similar appliances, the units require periodic maintenance. If the unit fails or a power outage occurs, the units are ineffective during the interim.

As a solution to the aforementioned shortcomings to an electrically refrigerated unit, insulated beverage coolers have been made that chill the beverages with ice in an attractive display. These coolers are basically large tubs that hold individually packed beverages together with ice, thus keeping the beverages in contact with the ice and cooled. Although these coolers are generally more mobile and convenient, they also are fraught with drawbacks.

Placing food or beverages on ice, although the food or beverage may be individually packaged, allows for the opportunity for contamination to the food or beverage by the melted ice. Sometimes the preferred product is packaged in a carton, like milk, and the carton becomes soggy after prolonged contact in ice and melted water. The melted ice may splash and spill out of the cooler, thus creating a slip-and-fall hazard. The beverages eventually may become completely immersed within the ice and water. This is inconvenient and also presents a health risk due to the spread of germs within the ice and water mixture. The accumulation of water as a cooling medium has the undesirable effect of impairing the degree of sanitation achievable and maintainable. There is a need, therefore, for a chilled beverage container that can maintain the required cooling effect on its contents while being mobile, efficient, sanitary, and inexpensive.

Decision Point Marketing, Inc. of Winston-Salem, N.C., has addressed this need by providing chilled item servers that require no electricity or loose ice. Exemplary of the chilled item servers marketed by Decision Point Marketing are the devices disclosed by U.S. Pat. No. 6,067,810 and pending U.S. patent applications Ser. No. 09/578,575 filed May 25, 2000, and Ser. No. 09/301,709 filed Apr. 29, 1999, the disclosures of which are hereby incorporated by reference. These devices generally include portable insulated containers having inner cavities lined with removable cold cells. The cold cells are formed of thermoplastic and have hollow cores filled with 1%–5% saline solution that can be frozen by placing the panels in a conventional freezer. Beverages are placed within the servers and subjected to the cool atmosphere created within the servers by the cold cells and are thereafter maintained at an effective temperature for consumption.

While the chilled item servers supplied by Decision Point Marketing have proven effective to eliminate the problems associated with electric or ice coolers, they may not be optimally sized for some point-of-sale applications. Because the overall size and capacity of each of these devices has been intentionally designed to address specific uses in the marketplace, they cannot be optimally adapted on a commercial scale to meet widely varying demands for units of different sizes or capacities. In particular, the cost of providing multiple molds of various shapes and sizes to produce an assortment of incrementally sized thermoplastic enclosures for these servers would be burdensome. Therefore, a need exists for an improved point-of-sale product chiller that can be economically produced in various sizes and capacities to address a broad range of market demands for such devices.

SUMMARY OF THE INVENTION

The present invention addresses this need in the art by providing a point-of-sale product chiller that includes a base panel having a top face and a bottom face, a pair of insulated sidewall panels each having an inside face and an outside face, and a plurality of modular, interchangeable, insulated, end wall panels each having an inner face and an outer face. A plurality of removable cold cell inserts having vertical edges are positioned along the inside faces of the sidewall panels and the inner faces of the end wall panels. The sidewall panels and end wall panels define a rectangular, upwardly-extending cavity for containing chilled product to be dispensed.

One or more bottom insulation panels may sit atop the top face of the base panel. A moisture tray with an upwardly extending lip may cover each bottom insulation panel so the lip fittingly engages the inside face of each adjacent sidewall panel and the inner face of each adjacent end wall panel. Preferably, the insulated sidewall panels and end wall panels each include a hollow outer shell with an insulating foam panel insert therein. These hollow panels are preferably formed of blow-molded thermoplastic. The removable cold cell inserts are sized and shaped to abut each other at their vertical edges, and the abutting vertical edges are configured to matingly engage each other to provide lateral support between adjacent cold cells in the chiller.

The chiller may be divided into multiple, rectangular, upwardly-extending cavities by including one or more insulated vertical central divider panels, each having a first and second face and extending laterally between the inner faces of opposite end wall panels. Preferably, each central divider panel includes a hollow outer shell with an insulating foam panel insert therein. The hollow outer shell of each central divider panel may be formed of blow-molded thermoplastic. A removable central cold panel is inserted adjacent each first face and second face of each central divider panel to surround each rectangular cavity with cold cells. In a preferred arrangement, the removable cold panel inserts adjacent each first and second face have vertical edges which abut the vertical edges of the adjacent cold cell inserts along the inner faces of the nearest end wall panels. The vertical edges of the adjacent cold cells are configured to matingly engage each other to provide lateral support between the adjacent cold cells.

Alternatively, the chiller may include one or more vertical central cold cell inserts in lieu of central divider panels for dividing the enclosure into multiple cavities. These vertical central cold cell inserts extend laterally between opposite inner faces of the end wall panels and have side edges that abut the vertical edges of adjacent cold cells along the inner faces of the end wall panels. The side edges and vertical edges of the cold cells are configured to matingly engage each other to provide lateral support between the adjacent cold cell inserts.

Because it may be desirable to promote or advertise products on the outside of the chiller or simply to decorate the chiller, a graphics area may be included on the outer face of each end wall panel for receiving replaceable indicia. A removable transparent side panel overlays the removable indicia and graphics area. Similarly, a signage area with replaceable indicia and a removable transparent end panel overlaying the indicia may be provided on the outside face of each sidewall panel.

A plurality of casters may be mounted on the bottom face of the base for convenient movement of the chiller. Also, a thermometer with a temperature-sensing probe in an interior region of the chiller and temperature readout on an outer surface of the chiller may be provided for conveniently monitoring the internal temperatures of the chiller. A movable lid may be included to cover each upwardly extending cavity. Preferably, the movable lid includes a plurality of transparent panels in overlapping, sliding arrangement over the upwardly extending cavity. Alternatively, the lid may be hinged along one edge of the cavity. For added rigidity and strength, reinforcement rods may be mounted at the top of the end panels and center panels to hold the panels together.

The invention also provides a method of dispensing chilled products. First, an enclosure is provided formed of modular insulated panels and having inner wall surfaces and an upwardly extending product-dispensing opening. Second, the inner wall surfaces of the enclosure are lined with removable chilled panels having vertical edges configured to matingly engage one another to provide lateral support therebetween and together forming a chilled product cavity within the enclosure. Third, chilled food items are placed in the chilled product cavity. Finally, chilled food items are dispensed through the product-dispensing opening.

This method may further include providing a movable lid on the enclosure over the product-dispensing opening, and opening the movable lid to dispense the chilled food items. The method may also include providing replaceable signage on outer surfaces of the enclosure to advertise or promote product in the enclosure to customers. Furthermore, the method may include moving the enclosure on casters to the point-of-sale. Also, the method may include installing one or more vertical central cold cells having vertical edges configured to matingly engage vertical edges of the cold cells lining the inner walls of the cavity so the central cold cells are laterally supported at their vertical edges and divide the chilled product cavity into multiple chilled sections for receiving and dispensing chilled food items.

The invention also provides a process for producing modular point-of-sale product chillers of variable size. The process includes producing insulated sidewall panels and end wall panels in various widths and producing incrementally-sized base panels sized in lengths and widths corresponding to the various sizes of end panels and side panels. Removable cold cells are produced in widths corresponding to the various widths of end panels and side panels. Two end panels and two side panels are selected and assembled on each base panel of corresponding width and length. Cold cells of corresponding widths are selected and assembled along inner surfaces of the end panels and side panels. The process may include producing insulated sidewall panels and end wall panels by blow-molding hollow plastic outer shells and inserting insulating foam panels therein.

Preferably, the process for producing modular point-of-sale product chillers of variable size includes providing molds for blow-molding sidewall panels, end wall panels, and base panels that include removable mold sections for adapting the molds to produce panels of various widths. Once base panels, sidewall panels, and end wall panels of desired sizes are produced in the molds, compatible panels are selected and assembled together to form chiller enclosures of desired sizes. Removable cold cells are provided in widths corresponding to the desired widths of the sidewall panels and end wall panels and assembled along the inner surfaces of the enclosure. The process may further include providing a mold including one or more removable mold sections for blow-molding central divider panels of various widths and producing central divider panels of desired widths in the mold. The divider panels are assembled in the enclosures to form multiple product cavities in the enclosures. Removable cold cells are provided in corresponding widths and assembled along the inner surfaces of the end wall and sidewall panels and along each face of each divider panel in the product cavities.

The process may also include a single mold for blow molding both the end wall panels and the divider panels in various desired widths. The single mold yields common panels including an end wall edge on one end and a divider edge on an opposite end. The divider edges are cut from the common panels to produce end wall panels. Similarly, the end wall edges are cut from the common panels to produce divider panels.

The invention also provides a point of sale product chiller including an outer insulating shell having a bottom and end walls defining a cavity, and a plurality of flat, removable cold cell inserts sized to fit along inside walls of the cavity and having edge shapes to cooperate with edge shapes of others of the removable cold cell inserts together with the end walls to hold the cold cell inserts upright in the cavity. In a preferred arrangement, one edge shape is convex and a cooperating edge shape is a concavity in which the convex edge can fit.

DETAILED DESCRIPTION OF THE PREFERRED EMBODIMENTS

Figure 1:
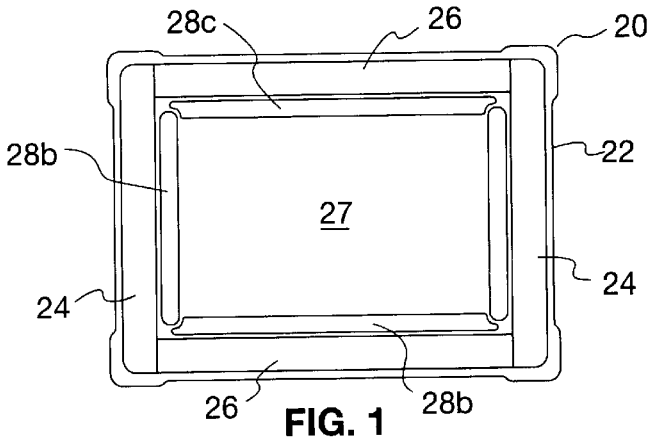
FIG. 1 is a top view of one embodiment of the invention.

The present invention provides an improved point-of-sale product chiller that is modular in design and construction and can be easily and economically adapted to various sizes and configurations. A first embodiment of the invention is shown in FIGS. 1–4. An insulated enclosure 20 includes a base panel 22, a pair of sidewall panels 24, and a pair of end wall panels 26. Removable cold cells 28*a* and 28*b* are assembled along the inner faces of the sidewall panels 24 and end wall panels 26 to form a chilled product cavity 27 in the enclosure with an upwardly extending product-dispensing opening 29. Details of the construction can be seen in FIG. 3 and FIG. 4.

The base 22, sidewall panels 24, and end wall panels 26 are formed of blow-molded thermoplastic and have hollow centers. The blow molding results in panels that have inside and outside walls joined by top and left and right walls, bounding a cavity. Other molding methods may be used, but blow molding is preferred as being versatile and inexpensive.

Figure 3:
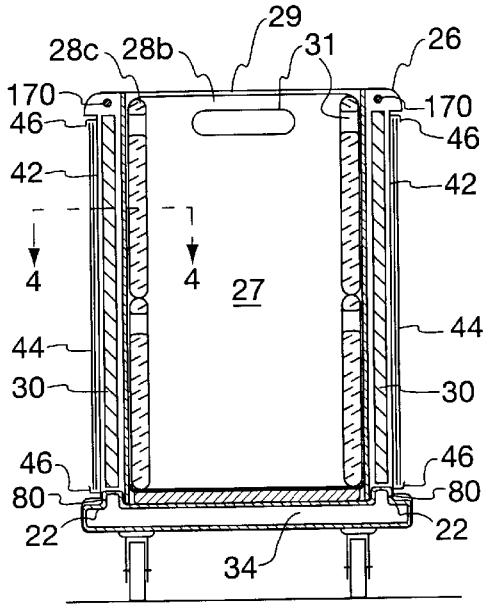
FIG. 3 is a cross-sectional view of the embodiment of FIG. 1 and FIG. 2 taken through line 3—3 as indicated in FIG. 2.
Figure 4:
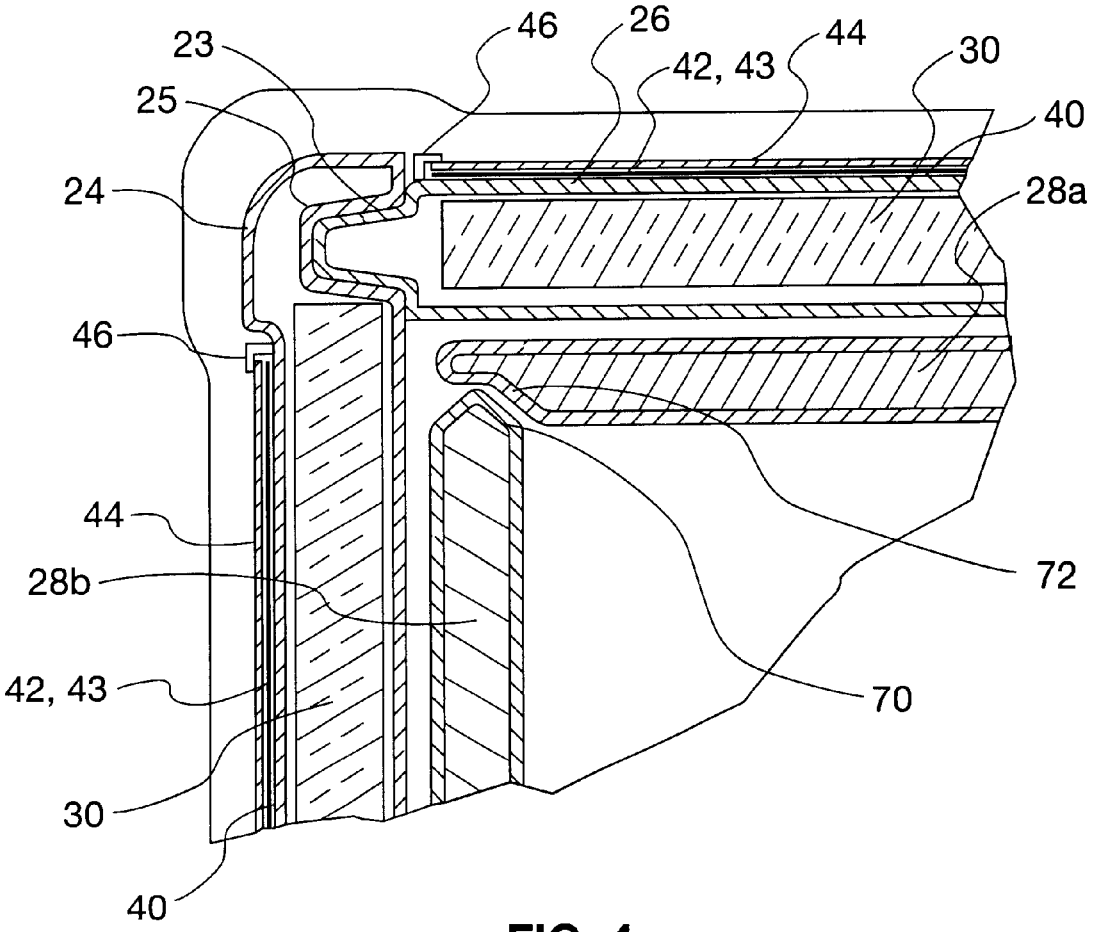
FIG. 4 is a top cross-sectional view of a corner of the embodiment of FIGS. 1–3 taken through line 4—4 as indicated in FIG. 3.
Figure 9:
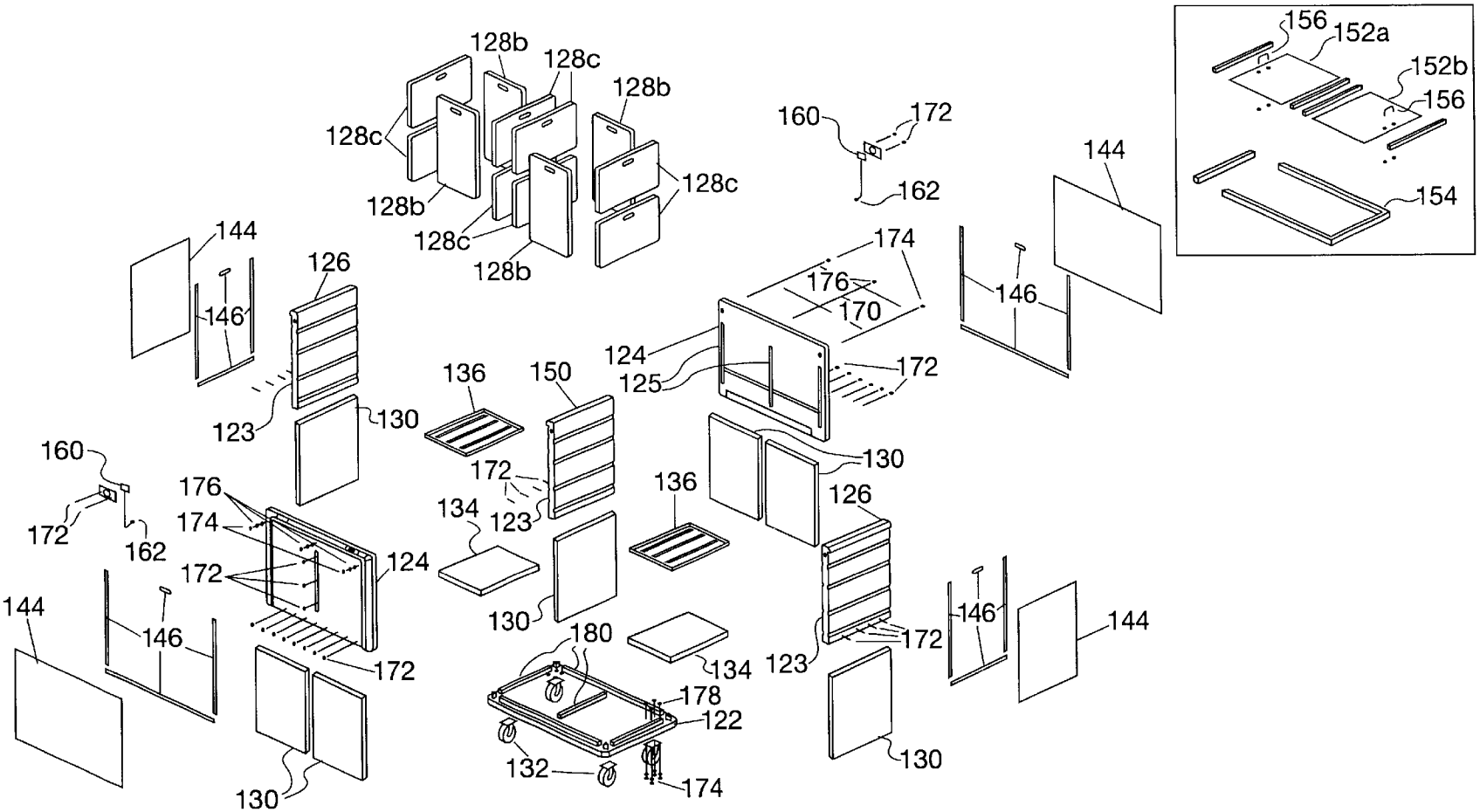
FIG. 9 is an exploded isometric view of the chiller shown in FIGS. 5 and 6.
Figure 12:
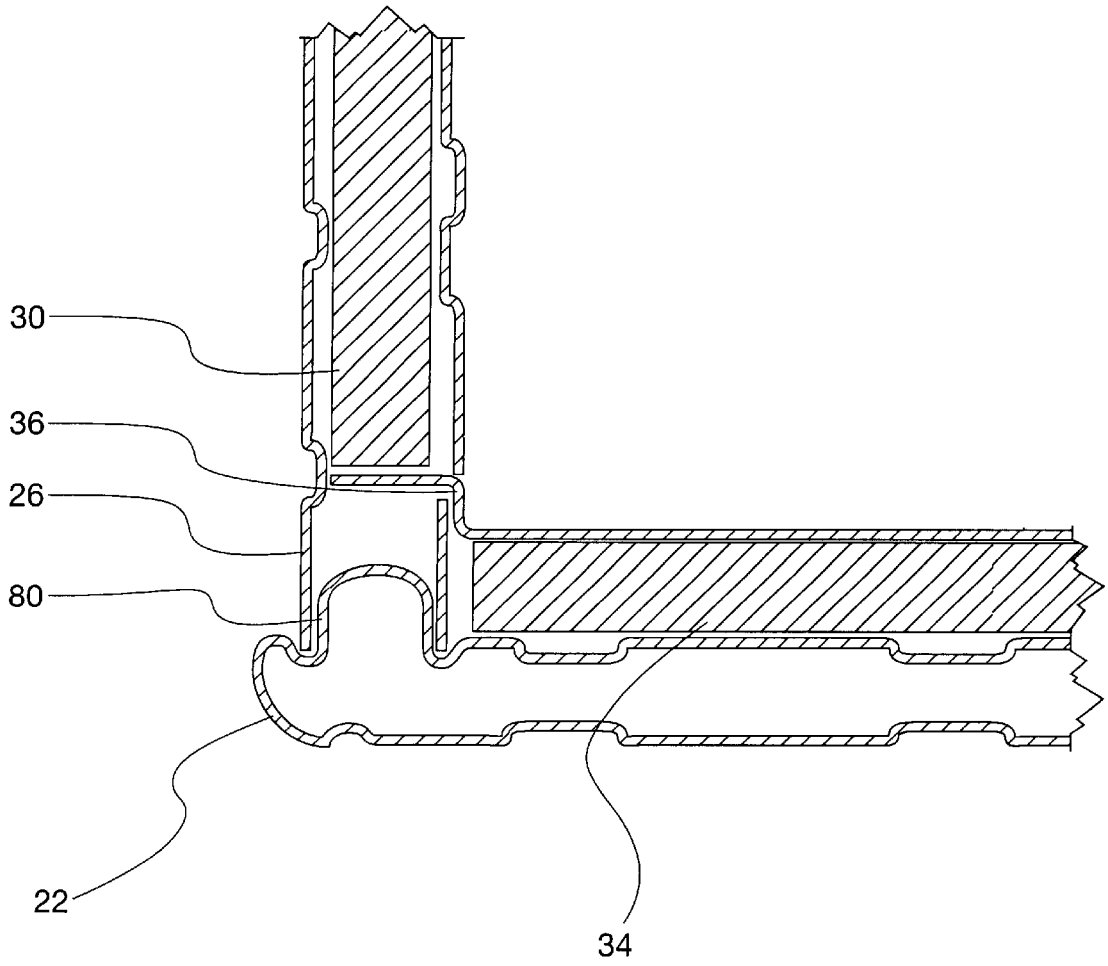
FIG. 12 is an enlarged detail of the cross-section shown in FIG. 3.

As seen in FIG. 4, the abutting edges of the end wall panels 26 and sidewall panels 24 may include mortises 25 and tenons 23 that engage to add rigidity and stability to the apparatus. As seen in FIGS. 3 and 12, the upper face of the bottom panel 22 has tenons 80 that engage slots in the lower ends of end wall and sidewall panels. Foam insulation panels 30 are located inside the hollow sidewall panels 24 and end wall panels 26. Alternatively, insulation can be injected or otherwise located in the panels. If preferred, other insulating materials can be used. The base 22 has a substantially flat upper face. A bottom insulation foam panel 34 lays on the upper face of the base 22 and is covered by a moisture tray 36 that nests in the bottom of the cavity 27. The moisture tray 36 collects condensation or spills inside the server, and is removable for cleaning. As best seen in FIG. 9, the molded plastic base 122, sidewall wall panels 126 and end panels 124 can be joined by conventional hardware items such as connecting rods having threaded ends 170, screws 172, bolts 178, nuts 174, and washers 176 and the like.

The chilled product cavities 27, 127, 227, and 327 may be of any desired size, but are preferably sized to accept standard chilled product containers such as milk crates or beer cases, for ease of loading and unloading the server. For example, the embodiment illustrated in FIG. 1 is configured to accept two standard, 24-quart dairy crates stacked one atop the other. Casters 32 are provided on the bottom of the base panel 22 for ease of movement of the server.

The removable cold cells 28*a* and 28*b* include hollow plastic shells containing a two-percent saline solution or other suitable freezing medium. The cold cells may be placed in a suitable freezer at a temperature of 0 to 20 degrees F. until the saline solution becomes frozen. The frozen cold cells are then assembled into the enclosure. Multiple interchangeable sets of cold cells may be used to continuously chill product in the server by replacing warmed cold cells with newly frozen cold cells when necessary. In a preferred arrangement, the panels can be removed from the top of the server without removal of any product already in the server.

As best seen in FIG. 4, the vertical edges 70 and 72 of the cold cells abut one another and mate together to laterally support one another when assembled in the enclosure, as shown. Other mating edge configurations may also be used to provide similar support between the cold cells, like that shown in FIGS. 8A, 8B, and 8C. Because a cold cell can be heavy to handle when the length and/or the width of the panel is great, it is preferable to minimize the size of each cold cell. As seen in FIG. 3, a plurality of short cold cells 28*c* may be provided and stacked as shown in lieu of a taller and heavier cold cell 28*a*. Hand-holes 31 are provided in each cold cell to facilitate handling, removal, and insertion of the cells.

Figure 2:
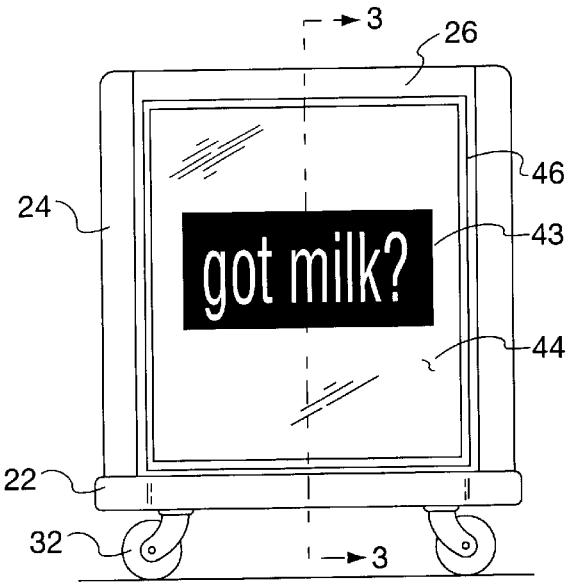
FIG. 2 is a front view of the embodiment shown in FIG. 1.

The invention also provides for replaceable signage on the outside of the server to promote and/or advertise chilled items in the server to consumers or to provide other displays. As seen in FIGS. 2–4, signage areas 40 are provided on one or more of the outer faces of the sidewall panels 24 and end wall panels 26. A sign panel 42 is placed over the area 40 and is secured in place and protected by a transparent lens panel 44. Preferably, the sign panel 42 is heavy paper or cardstock. The lens panel 44 is secured by lens retainer strips 46 attached along the periphery of the signage area 40. Advertising indicia 43 is printed on the outer face of the sign panel 42 and is visible through the transparent lens panel 44. The lens panel 44 is preferably somewhat flexible, so that it can be distorted, if desired, for removal from the strips 46. This enables the sign panel 42 to be replaced with a different sign panel 42 that promotes a different product, uses a different promotional campaign for the same product, or includes other graphics.

Figure 6:
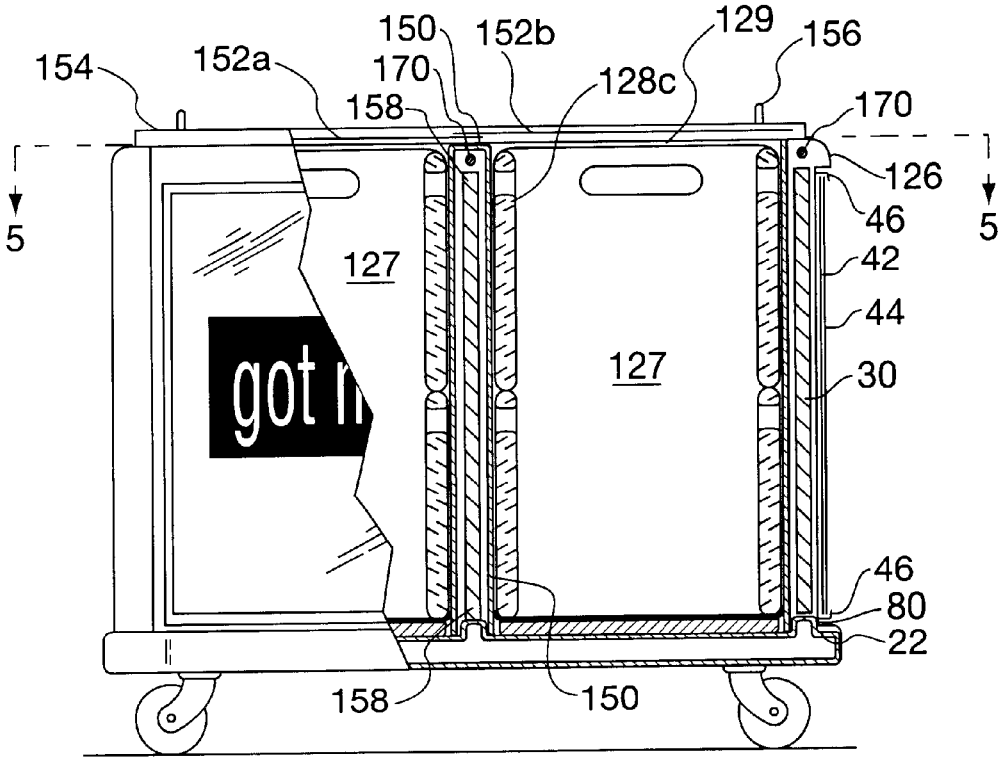
FIG. 6 is a front view of the embodiment of FIG. 5 showing a partial section taken through line 6—6 as indicated in FIG. 5.

As seen in FIGS. 6 and 9, the server may be provided with a movable cover mounted over the openings 129. The movable cover includes a plurality of sliding lids 152*a* and 152*b*, mounted in sliding arrangement on the top of the server above the product-dispensing openings 129. A frame 154 supports and guides the sliding lids 152*a* and 152*b*. Handles 156 are provided for gripping to open and close the lids. Preferably, the sliding lids are transparent to permit a customer to view the contents in the server when the lids are closed. Alternatively, a hinged cover may be included.

The server may also include a thermometer for monitoring the temperature inside the chilled product cavities. A readout display 160 is mounted on an upper edge of the server. The display 160 is connected to a temperature-sensing probe 162 located in a chilled product cavity 127. Preferably, the thermometer and readout are digital. Multiple thermometers may be included for servers having more than one chilled product cavity. The thermometers indicate when the temperature inside the chiller has warmed sufficiently that the cold cells should be replaced with newly frozen panels.

Figure 5:
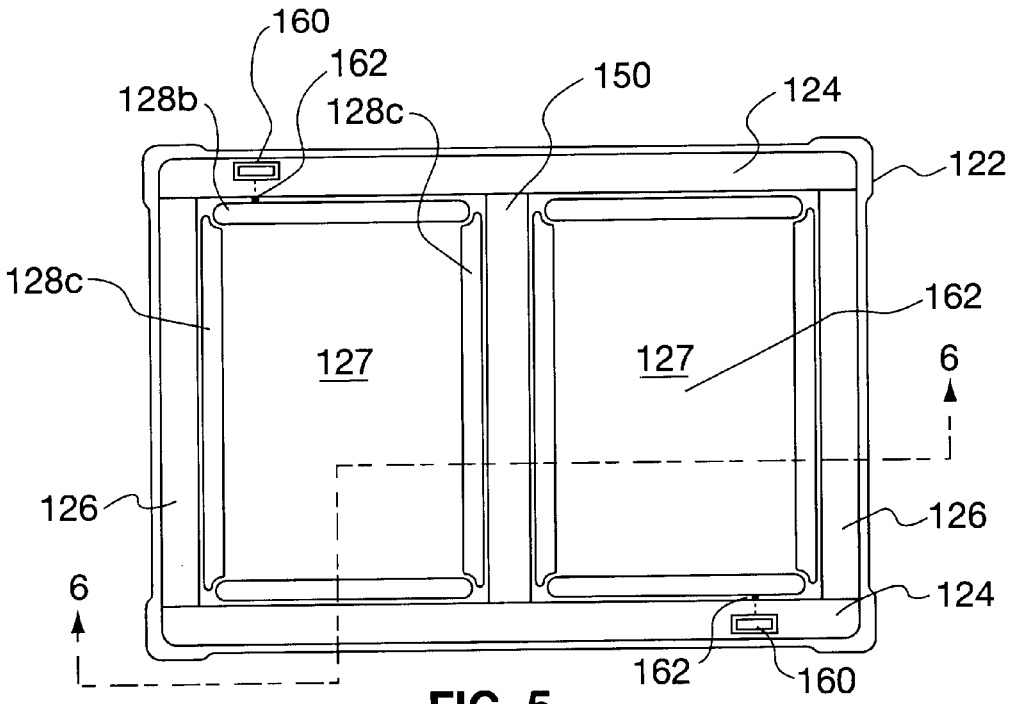
FIG. 5 is a top sectional view of a second embodiment of the invention taken through line 5—5 as indicated in FIG. 6.

Details of the construction of the invention and specifically the embodiment of FIGS. 5 and 6 are best seen in the exploded isometric view of FIG. 9. In this embodiment, the end wall and sidewall panels 124 and 126 are provided with mating mortises 125 and tenons 123 for rigidity and stability of the joined panels. The bottom panel 122 includes bottom tenons 180 on its upper face which engage mating openings in the lower ends of the end wall panels 126, sidewall panels 124, and central divider panels 150, if any. Foam insulation panels 130 are inserted into the end wall and sidewall panels. Casters 132 are mounted to the bottom of the base panel 122.

Lens retainer strips 146 attach the lens panels 144 to the outside faces of the enclosure to retain advertising or promotional signage (not shown). Bottom foam panels 134 are placed atop the top face of the bottom panel 122 and covered by moisture trays 136 including edges that resiliently engage adjacent inside faces of the end wall, sidewall, and central divider panels. Cold cell inserts 128*b* and 128*c* line the cavities in the enclosure. Sliding lids 152*a* and 152*b* with handles 156 may cover the top of the chiller in sliding arrangement in a frame 154. One or more thermometers 160 with probes 162 are assembled in the chiller to monitor temperatures inside the chiller.

Figure 7:
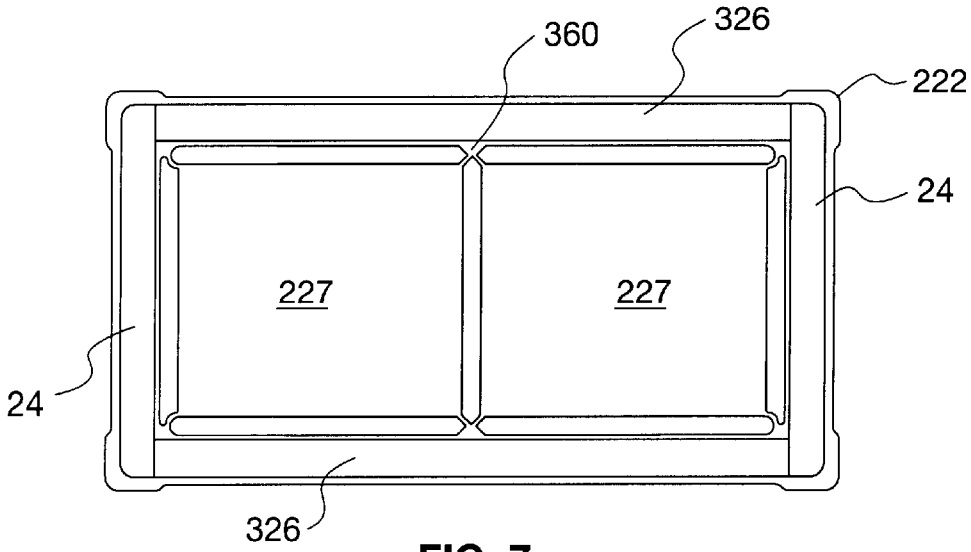
FIG. 7 is a top view of a third embodiment of the invention.

The modular panel design and construction permits economical production of a wide variety of incrementally-sized product chillers. The blow-molded base panels 22, sidewall panels 24, and end wall panels 26 may be incrementally sized and combined to create an array of product chillers of varying sizes and capacities. Other possible modular panel combinations are shown in FIGS. 7 and 8. The embodiment of FIG. 7 is sized to receive 16-quart milk crates and includes a base panel 222, a pair of narrow end wall panels 326, and a pair of sidewall panels 24. The sidewall panels 24 are the same sidewall panels used in the chiller shown in FIG. 1. In addition, central cold cells 360 can be inserted to define multiple chilled product cavities 227 in the server.

Figure 8A:
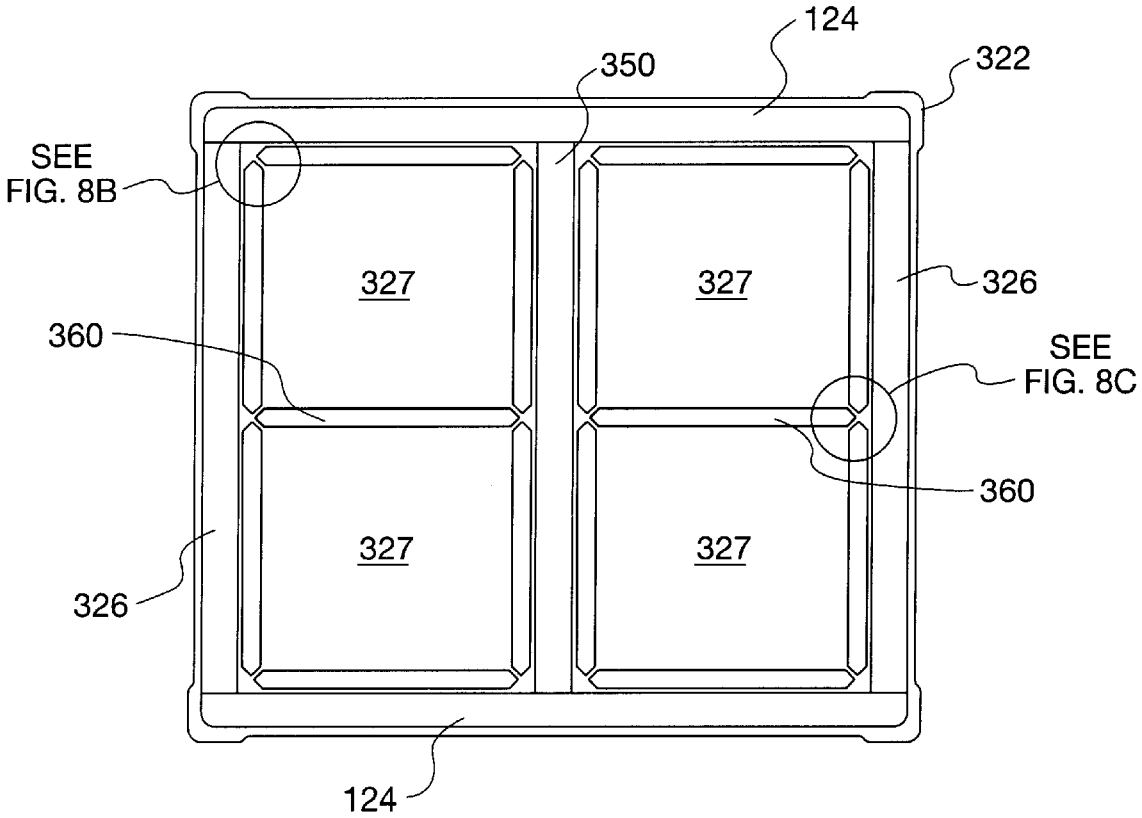
FIG. 8A is a top view of a fourth embodiment of the invention.
Figure 8B:
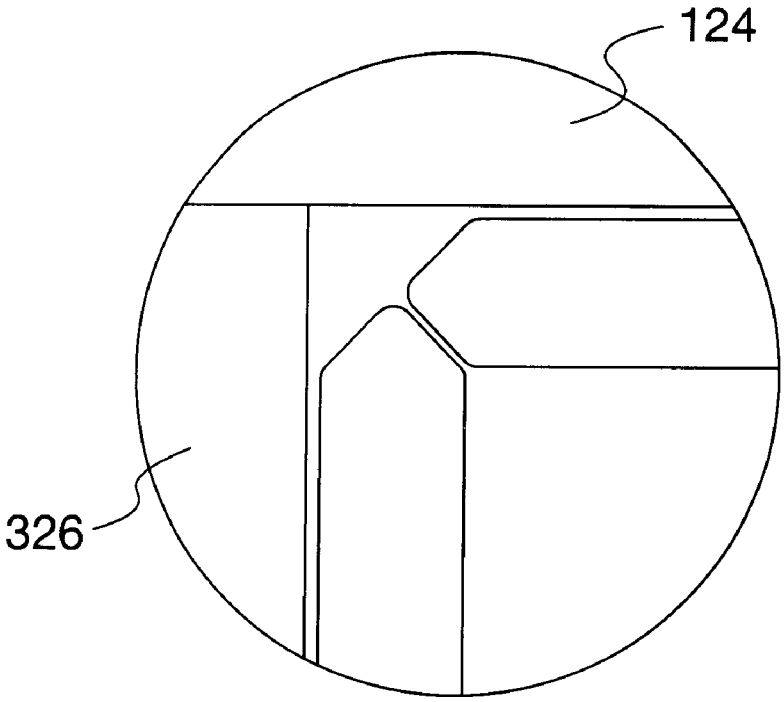
FIGS. 8B and 8C show details of cold cell edge shapes and interfaces as indicated in FIG. 8A.
Figure 8C:
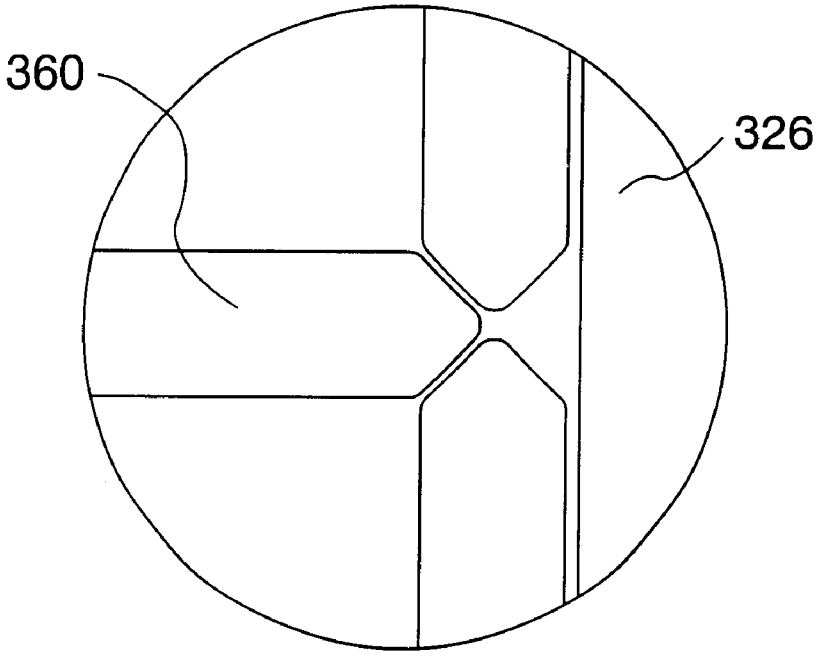

Another embodiment is shown in FIG. 8. A wide base panel 322 and pair of wide end wall panels 326 are assembled together with a pair of sidewall panels 124. The same sidewall panels 124 used in the embodiments shown in FIGS. 5 and 7 are included to form a larger chiller with a larger capacity. As shown in FIG. 8A, central divider panels 350 and central cold cells 360 may be used to divide the server into multiple chilled product cavities 327. The replaceable signage and moveable cover arrangements discussed above may be adapted to any of these various server embodiments.

Figure 10A:
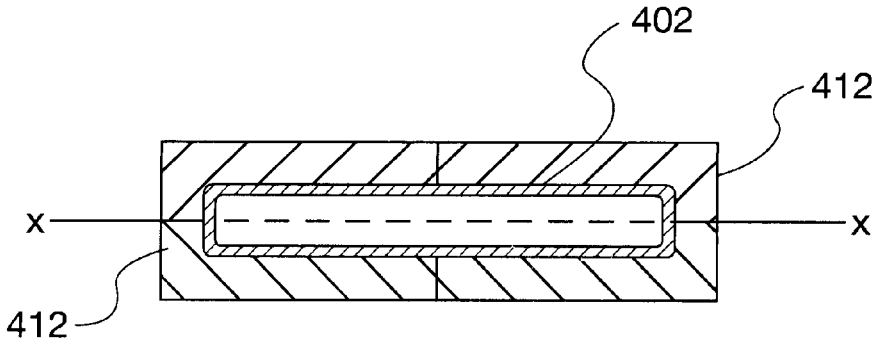
FIGS. 10A and 10B are section views of molds for enclosure.
Figure 10B:
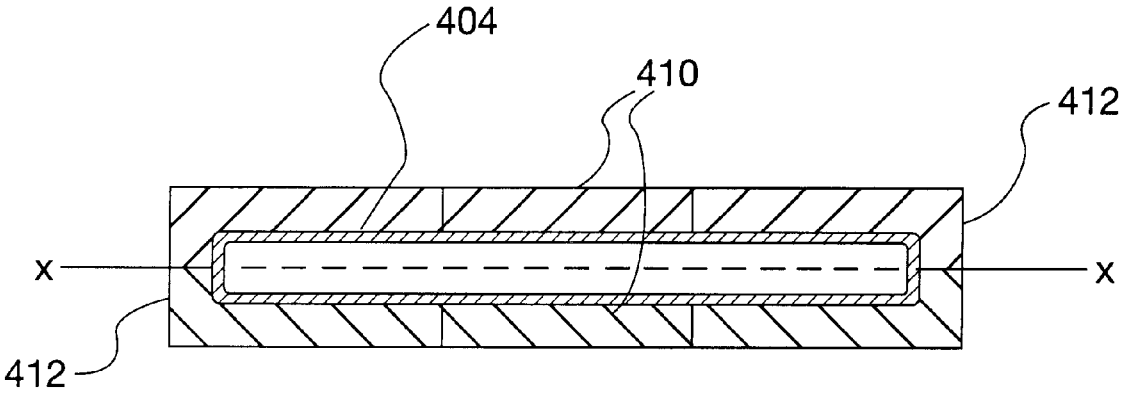

Production costs are minimized by using a minimum number of costly production molds to blow-mold the bottom, end wall, and sidewall panels in the desired incremental sizes. As illustrated in FIGS. 10A and 10B, blow molds for each molded component may have one or more removable mold sections 410 to permit panels of various widths to be molded from a single mold assembly. For example, a narrow end wall panel 402 can be produced from an end wall panel mold including only two mold end sections 412 having parting line X—X. A mold expansion section 410 may be inserted between the two mold end sections to blow-mold a wider end wall panel 404 for a wider chiller assembly. This same adjustable-mold production process may be used for end wall panels, sidewall panels, base panels, and/or central divider panels.

Figure 11:
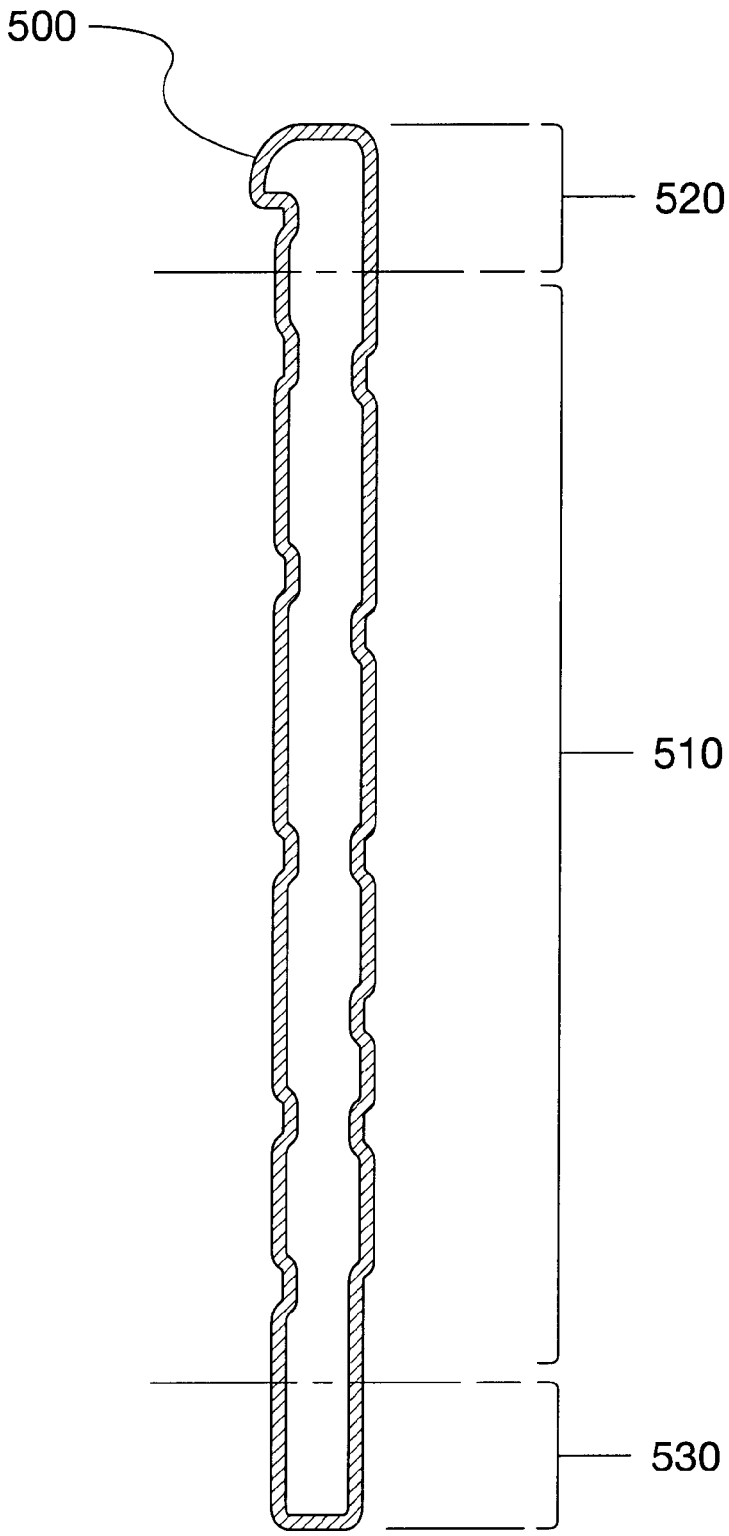
FIG. 11 is a cross-sectional view of a common panel for making both end wall and divider panels.

Production costs are further minimized by using a single mold to produce both the end wall and central divider panels. As shown in FIG. 11, a common panel 500 is molded to include a common center portion 510, an end wall panel edge portion 520, and a divider panel edge portion 530. For end wall panels, the divider panel edge portion 530 is removed from the common panel to leave only portions 510 and 520. Alternatively, to produce a divider panel, the end wall panel edge portion 520 is removed from the common panel. As best seen in FIG. 12, the resulting open end of the hollow panel left by the parted edge portions 520 or 530 receives an insulating foam panel insert 30 and engages a tenon 80 on the base panel 22. As discussed above, the common panels and resulting end wall and divider panels may be produced in various incremental widths from a single mold assembly.

As will be apparent to those of ordinary skill in the art, the invention can be adapted to various configurations of product chillers and is not limited to the specific embodiments discussed above. Those of ordinary skill in the art will also appreciate that the invention could be carried out in other various forms, all of which are deemed to be within the scope of the appended claims.

What is claimed is:

1. A modular, point-of-sale, product chiller comprising:

a base panel having a top face and a bottom face, a pair of insulated sidewall panels each having an inside face and an outside face, a pair of insulated end wall panels each having an inner face and an outer face, and a plurality of removable cold cell inserts having vertical edges and positioned along the inside faces of the sidewall panels and the inner faces of the end wall panels, wherein the sidewall panels and end wall panels define a rectangular, upwardly-extending cavity for containing product to be dispensed.

2. The point-of-sale product chiller claimed in claim 1 further including:

one or more foam insulation panels atop the top face of the base panel, and a moisture tray covering each foam insulation panel and nested between the adjacent inside faces of the sidewall panels and inner faces of the end wall panels.

3. The point-of-sale product chiller claimed in claim 1 wherein the insulated sidewall panels and end wall panels each include a hollow outer shell and an insulating foam panel insert contained therein.

4. The point-of-sale product chiller claimed in claim 3 wherein the hollow outer shells of the sidewall panels and end wall panels and the base panel are formed of blow-molded plastic.

5. The point-of-sale product chiller claimed in claim 1 wherein the removable cold cell inserts are sized and shaped to abut each other at their vertical edges and the abutting vertical edges are configured to matingly engage each other to provide lateral support between adjacent cold cells.

6. The point-of-sale product chiller claimed in claim 1 further including:

one or more insulated vertical central divider panels each having a first and second face and extending laterally between the inner faces of opposite end wall panels, and a removable central cold panel insert adjacent each first face and second face of each central divider panel.

7. The point-of-sale product chiller claimed in claim 6 wherein each central divider panel includes a hollow outer shell and an insulating foam panel insert therein.

8. The point-of-sale product chiller claimed in claim 7 wherein the hollow outer shell of each central divider panel is formed of blow-molded plastic.

9. The point-of-sale product chiller claimed in claim 6 wherein the removable cold panel inserts adjacent each first and second face have vertical edges which abut the vertical edges of the adjacent cold cell inserts along the inner faces of the nearest end wall panels, and the vertical edges of the adjacent cold cells are configured to matingly engage each other to provide lateral support between the adjacent cold cells.

10. The point-of-sale product chiller claimed in claim 1 further including one or more vertical central cold cell inserts extending laterally between opposite inner faces of the end wall panels and having side edges which abut the vertical edges of adjacent cold cells along the inner faces of the end wall panels, wherein the side edges and vertical edges are configured to matingly engage each other to provide lateral support between the adjacent cold cell inserts.

11. The point-of-sale product chiller claimed in claim 1 further including a graphics area on the outer face of each end wall panel, replaceable indicia over the graphics area, and a removable transparent side panel overlaying the removable indicia and graphics area.

12. The point-of-sale product chiller claimed in claim 1 further including a signage area on the outside face of each sidewall panel, replaceable indicia over the signage area, and a removable transparent end panel overlaying the removable indicia and signage area.

13. The point-of-sale product chiller claimed in claim 1 further including a plurality of casters mounted on the bottom face of the base panel.

14. The point-of-sale product chiller claimed in claim 1 further including a thermometer having a temperature sensing probe in an interior region of the chiller and a temperature readout on an outer surface of the chiller.

15. The point-of-sale product chiller claimed in claim 1 further including a movable lid covering the upwardly extending cavity.

16. The point-of-sale product chiller claimed in claim 15 wherein the movable lid includes a plurality of transparent panels in overlapping, sliding arrangement over the upwardly extending cavity.

17. The point-of-sale product chiller claimed in claim 15 wherein the movable lid includes a transparent hinged cover over the upwardly extending cavity.

18. The point-of-sale product chiller claimed in claim 1 further including connecting rods holding the panels together.

19. A modular point-of-sale product chiller comprising:

a base panel having a top face and a bottom face including a plurality of casters mounted to the bottom face;

a pair of insulated sidewall panels each having an inside face and an outside face, and having a hollow outer shell of blow-molded plastic with an insulating foam panel insert contained therein;

a plurality of modular interchangeable insulated end wall panels each having an inner face and an outer face, and having a hollow outer shell of blow-molded plastic with an insulating foam panel insert contained therein;

one or more insulated vertical central divider panels each having a first and second face, having a hollow outer shell of blow-molded plastic with an insulating foam panel insert contained therein, and extending laterally between opposite inner faces of the end wall panels;

one or more foam insulation panels atop the top face of the base panel and a moisture tray covering each foam insulation panel and nested between the faces of adjacent end wall and sidewall panels, a plurality of removable cold cell inserts having vertical edges and positioned along the inside faces of the sidewall panels, the inner faces of the end wall panels, and the first and second faces of each central divider panel, wherein the vertical edges of adjacent cold cell inserts are configured to matingly engage each other to provide lateral support between the adjacent cold cell inserts;

a graphics area on an outer face of at least one of the end wall panels or sidewall panels, replaceable indicia over the graphics area, and a removable transparent lens panel overlaying the removable indicia and graphics area;

a thermometer having a temperature sensing probe in an interior region of the chiller and a temperature readout on an outer surface of the chiller;

wherein the sidewall panels, end wall panels, and cold cells form an upwardly extending chilled product-dispensing opening, with a plurality of transparent covers in sliding arrangement over the opening.

20. A method of dispensing chilled products comprising:

providing an enclosure formed of modular insulated panels and having inner wall surfaces and an upwardly extending product-dispensing opening, lining the inner wall surfaces of the enclosure with removable chilled panels having vertical edges configured to matingly engage one another to provide lateral support therebetween and together forming a chilled product cavity within the enclosure, placing chilled food items in the chilled product cavity, and dispensing the chilled food items through the product-dispensing opening.

21. The method claimed in claim 20 further including:

providing a movable lid on the enclosure over the product-dispensing opening, and opening the movable lid to dispense the chilled food items.

22. The method claimed in claim 20 further including providing replaceable signage on outer surfaces of the enclosure to advertise product in the enclosure to customers.

23. The method claimed in claim 20 further including providing casters on a bottom of the enclosure and moving the enclosure on the casters to the point-of-sale.

24. The method claimed in claim 20 further including providing one or more vertical central cold cells to divide the chilled product cavity into multiple chilled sections for receiving and dispensing chilled food items, each central cold cell having vertical edges configured to matingly engage vertical edges of the removable cold cells lining the inner walls of the cavity whereby the central cold cells are laterally supported at the vertical edges.

25. A process for producing modular point-of-sale product chillers of variable size comprising:

producing insulated end panels in various widths and including inner and outer surfaces;

producing insulated side panels in various widths and including inner and outer surfaces;

producing incrementally-sized base panels sized in lengths and widths corresponding to various widths of produced end panels and side panels, producing removable cold cells in widths corresponding to the various widths of end panels and side panels;

selecting and assembling two end panels and two side panels on each base panel of corresponding size; and selecting and assembling the cold cells of corresponding widths along the inner surfaces of the end panels and side panels.

26. The process claimed in claim 25 wherein producing insulated end panels and side panels includes blow-molding hollow plastic outer shells and inserting insulating foam panels therein.

27. A process for producing modular point-of-sale product chillers of variable size comprising:

providing molds for blow-molding sidewall panels, end wall panels, and base panels including removable mold sections for adapting the molds to produce panels of various widths;

producing base panels, sidewall panels, and end wall panels of desired widths in the molds;

selecting and assembling the sidewall panels and end wall panels together on the base panels to form chiller enclosures of desired sizes; and providing removable cold cells in widths corresponding to the desired widths of the end panels and side panels and assembling the cold cells along the inner surfaces of the enclosure.

28. The process claimed in claim 27 further including:

providing a mold including one or more removable mold sections for adapting the mold to blow-mold central divider panels of various widths;

producing central divider panels of desired widths in the mold;

assembling the divider panels in the enclosures to form multiple product cavities in the enclosures; and providing removable cold cells in widths corresponding to the desired sizes of the end panels, side panels, and divider panels and assembling the cold cells along the inner surfaces of the end wall and sidewall panels and along each face of each divider panel.

29. The process claimed in claim 28 wherein the mold for blow molding end wall panels in various widths and the mold for blow molding divider panels in various widths is a single mold that yields common panels having an end wall edge on one end and a divider edge on an opposite end, producing end wall panels includes removing the divider edges from the common panels, and producing divider panels includes removing the end wall edges from the common panels.

30. A point of sale product chiller comprising:

an outer insulating shell having a bottom and end walls defining a cavity, a plurality of flat, removable cold cell inserts sized to fit along inside walls of the cavity and having edge shapes to cooperate with edge shapes of others of the removable cold cell inserts together with the end walls to hold the cold cell inserts upright in the cavity.

31. A chiller as claimed in claim 29 wherein one edge shape is convex and a cooperating edge shape is a concavity in which the convex edge can fit.

* * * * *